US007484878B1

(12) United States Patent
McCole

(10) Patent No.: US 7,484,878 B1
(45) Date of Patent: Feb. 3, 2009

(54) VANITY LIGHTING APPARATUS

(76) Inventor: Joseph Albert McCole, 445 Sullivan La., #162, Reno, NV (US) 89504

( * ) Notice: Subject to any disclaimer, the term of this patent is extended or adjusted under 35 U.S.C. 154(b) by 0 days.

(21) Appl. No.: 11/683,556

(22) Filed: Mar. 8, 2007

Related U.S. Application Data

(60) Provisional application No. 60/780,636, filed on Mar. 8, 2006.

(51) Int. Cl.
*H01R 33/00* (2006.01)

(52) U.S. Cl. ..... 362/652; 362/135; 362/140

(58) Field of Classification Search ..... 362/652, 362/135, 140, 141, 225, 647
See application file for complete search history.

(56) References Cited

U.S. PATENT DOCUMENTS 5,295,055 A * 3/1994 Brock et al. ..... 362/249
6,318,877 B1 * 11/2001 Dehn ..... 362/136
6,964,504 B2 * 11/2005 Newbold ..... 362/375

* cited by examiner

*Primary Examiner*—John A Ward
(74) *Attorney, Agent, or Firm*—Lewis and Roca LLP

(57) ABSTRACT

A vanity-lighting system for providing light to a reflective surface for the application and removal of cosmetics. The system includes multiple segments. Each segment including at least one light fixture, a mounting device for affixing the segment to a surface, and connectors that allow each segment to be connected to adjoining segments. The system is affixed to a wall by first connecting the adjoining segments in the desired geometric shape and then affixing the connected segments to a surface. Preferably, the surface is proximate a mirror or other reflective surface.

10 Claims, 4 Drawing Sheets

VANITY LIGHTING APPARATUS

CROSS-REFERENCE TO RELATED APPLICATIONS

This application claims the benefit of U.S. Provisional Patent Application Ser. No. 60/780,636, filed Mar. 8, 2006, the entirety of which is incorporated by reference herein.

FIELD OF THE INVENTION

This invention relates to a lighting system. More particularly, this invention relates to a portable vanity lighting system. Still more particularly, this invention relates to a portable lighting system that is segmented to allow complete lighting of an area when attached to a mirror or other surface to facilitate application of make-up to a face.

PRIOR ART

It is a problem to provide proper lighting for a mirror surface for application of make-up. In order to apply make-up, most users want the face illuminated from all angles to prevent shadows and shading that may hinder the appropriate application of the make-up. Most users applying make-up in a hotel room, locker room or temporary dormacile complain that the lighting for the mirrors is not adequate for applying make-up.

In the past, some solutions to this problem include lighted compacts or other smaller mirrors surrounded by lighting. However, these mirrors have a problem in that the mirror may not be of an appropriate size for a user to see their entire face. Other systems may have lights that generate too much heat and make a user uncomfortable while proximate the lights. Thus, there is a need in the art for a portable system for lighting a mirror.

SUMMARY OF THE INVENTION

The above and other problems are solved and an advance in the art is made by a vanity lighting apparatus in accordance with this invention. A first advantage of a system in accordance with this invention is that it provides a portable vanity lighting system that is lightweight and easy to carry in a small case, purse, or other luggage. A second advantage of a system in accordance with this invention is that the segments may be configured to have different shapes to fit around different mirrors and different spaces. A third advantage of a vanity light system in accordance with this invention is that the segments can be reinforced to prevent forces applied during installation and/or removal do not damage the system.

In accordance with an embodiment of this invention, a vanity lighting system is configured in the following manner. The vanity lighting system is made of multiple segments. Each segment has a first end, second end, and topside, bottom side and sidewalls. There is at least one light fixture on the topside of each segment. Each light figure is configured to receive a light bulb and to provide power to the light bulb to provide illumination. At least one mounting device on the bottom side of each segment to affix the segment to a surface, such as a mirror or a wall. Connectors at each end of a connector are mated to connect to the connectors at the ends of neighboring or adjoining segments to form one lighting system around the perimeter of a mirror or other reflective surface to facilitate the application and removal of cosmetics.

BRIEF DESCRIPTION OF THE DRAWINGS

The above and other features and advantages of a vanity lighting apparatus in accordance with this invention are described in the following detailed descriptions and are illustrated in the following drawings.

DETAILED DESCRIPTION OF THE INVENTION

Figure 1:
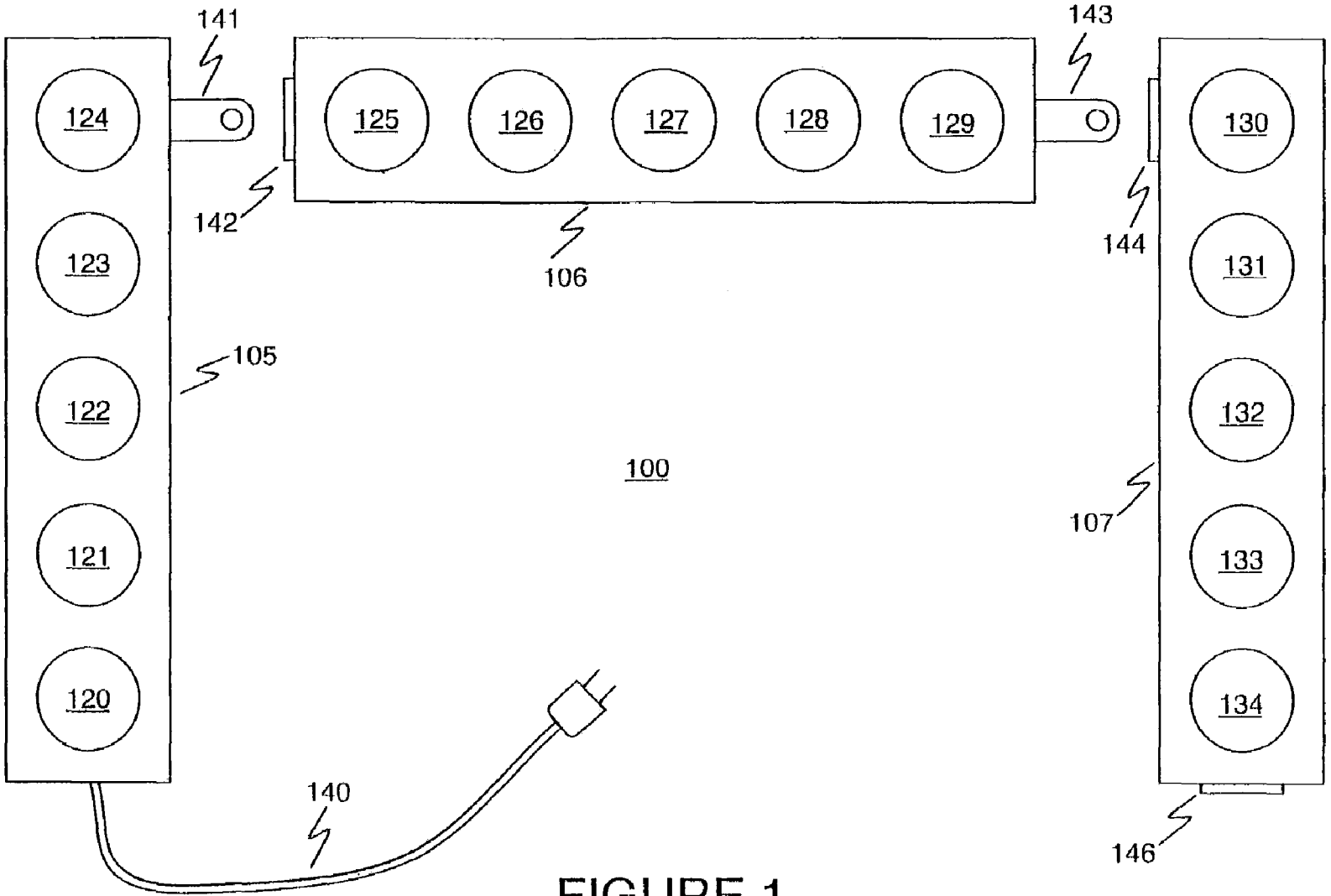
FIG. 1 illustrating a front view of an exemplary embodiment of a vanity lighting apparatus in accordance with this invention.

This invention is a portable lighting system that may be affixed to and/or proximate a mirror to provide lighting for the application of make-up. FIG. 1 illustrates a preferred exemplary embodiment of this invention. Lighting system 100 includes three interconnecting segments 105-107. Each interconnecting segment has a base 110-112. Each base 110-112 has sockets for light bulbs 120-135. Preferably, the bulb sockets are at least five and one-half inches (5 and _") from the ends of each segment and are spaced between two to three inches (2"-3") apart from one another along the surface of the segment.

Preferably, each bulb is a 120-volt, 15-Watt bulb with thirteen/sixteenth inch (13/16") diameter, thirteen/sixteenth inch (13/16") height, and a six/sixteenth inch (6/16") diameter candle bra size. Also preferably, the two side segments 105, 107 are fourteen inches (14") length and horizontal segment 106 is twenty-two inches (22") in length. One skilled in the art will recognize that all of the given dimensions may be changed by those skilled in the art without changing this invention. Also those skilled in the art will recognize that the number of segments and orientation of the segments may be changed by those skilled in the art without changing the concept in accordance with this invention.

Figure 3:
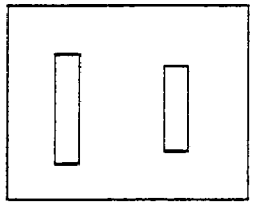
FIGS. 3-7 illustrating various ends of segments of a vanity lighting apparatus in accordance with this invention.
Figure 4:
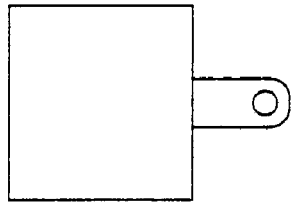

Each segment has a connector 140-146 at opposing ends of the segment. The connector may be on a side surface or an end surface of the segment. Each connector is designed to mate in a plug-receptor relationship with an adjoining connector. For example, connector 141 has a male plug 400 (Shown in FIG. 4) that fits into a female receptor 300 of connector 142 (Shown in FIG. 3) of segment 106. One of the segments has a connector, such as connector 140, that has a plug and cord that connects to a power outlet.

Figure 9:
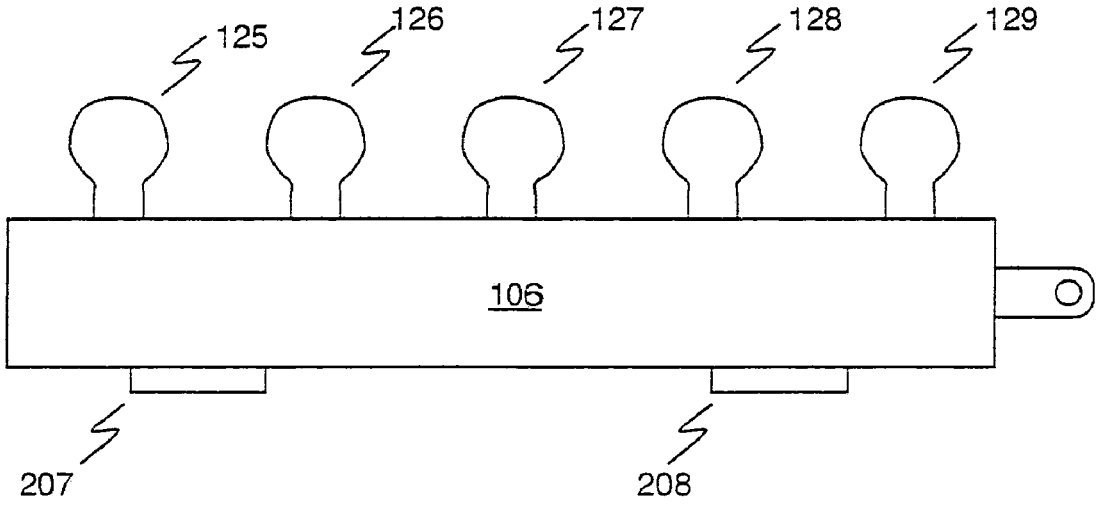
FIG. 9 illustrating a side view of a segment of a vanity lighting system in accordance with the shown embodiment of this invention.

A side view of segment 106 is shown in FIG. 9. One skilled in the art will recognize that although just one segment is shown and described all of the segments are configured in substantially the same manner in accordance with this invention. In FIG. 9, light bulbs 125-129 extend outward from topside of connecter 106 from fixtures in the topside. One end of segment 106 has a male power plug for a connector. The other side has a female power receptor (Not seen in FIG. 9). Mounting devices 207 and 208 extend out of a bottom side of segment.

Figure 2:
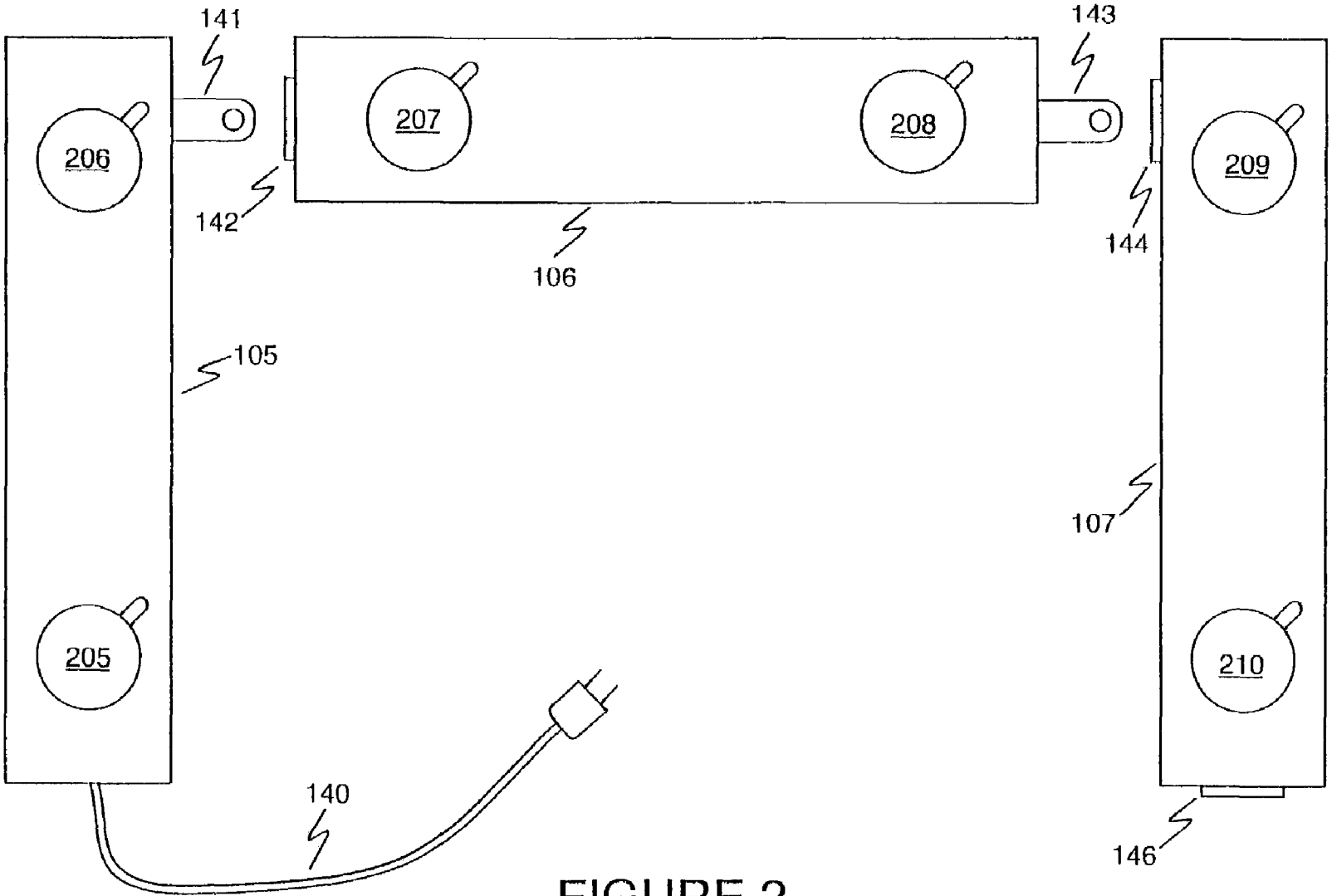
FIG. 2 illustrating a rear view of an exemplary embodiment of a vanity lighting apparatus in accordance with this invention.

On the side of segments 105-107 opposite the lighting features is a backside of the segments shown in FIG. 2. The backsides of each segment include mounting devices 205-210. Mounting devices 205-210 affix the lighting system to the surface of a mirror or wall adjacent a mirror. Preferably, mounting devices 205-210 are suction cups that may include a tab 211-216 for easy removal. One skilled in the art will recognize that while suctions cups are preferred other types of mounting devices may be used including, but not limited to, adhesive strips, loop, hook mounts and Velcro.

Figure 8:
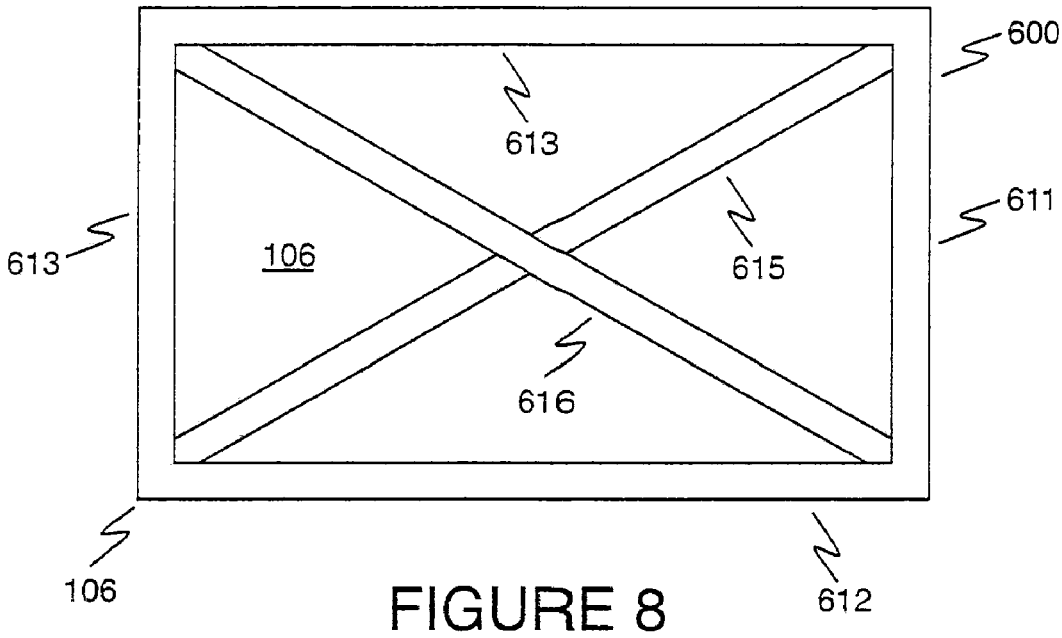
FIG. 8 illustrating a support structure inside a segment of a vanity lighting apparatus in accordance with this invention.

FIG. 8 illustrates a cross section of a segment 106 showing a support structure 600 inside of a segment. In this embodiment, support structure 600 is inside of segment 106 directly over a mounting device. Thus, making segment more rigid in at this location. The added rigidity adds support to segment to prevent the pressure applied by a user to affix the mounting devices to a mirror or other surface from crushing or in some other way damaging the segment. In this embodiment, support structure 600 includes four support beams 610-613 which are affixed to one another at opposing ends and each have an outer surface affixed to an interior surface of sidewalls of the segments.

Two cross beams 614-615 each have opposing ends affixed to the corners formed by the connected ends of beams 610-613. One skilled in the art will recognize that in some embodiments only one crossbeam may be used. In other embodiments, other geometric structures may be used to provide supports. These geometric structures includes arches, hexagonal rings forming combs, and any other structure that can increase the pressure that the segment can withstand before deforming. Furthermore, one skilled in the art will recognize that these supports structures may be added anywhere inside the segment to add rigidity to the segment. In most instances, such supports is envisioned to be proximate the positions of mounting devices and lighting fixtures as these are the areas that will be exposed to the most force by users.

Figure 5:
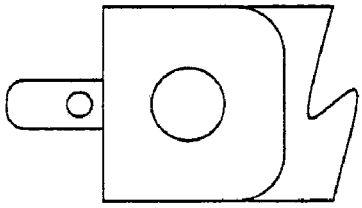
Figure 6:
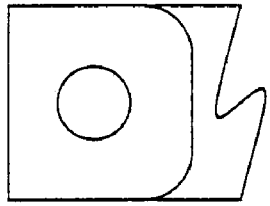

FIGS. 5 and 6 illustrate male and female connectors 500 and 600 that are mounted on a swivel 505-605 to allow the connectors to pivot to allow the segments to be arranged in different configurations. Swivels 505 and 605 include a pin, bolt, or rod that provides an axis about which swivel 505-605 may rotate. Swivel 505-605 may rotate the connected to either position (up or down) that is substantially perpendicular to a longitudinal axis of the segment.

Figure 7:
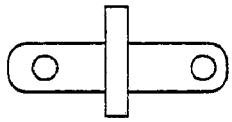

In other embodiments, all connectors may be female and a male/male plug 700 as shown in FIG. 7 may be inserted into the female connectors to connect adjoining segments.

The above description is of an exemplary embodiment of a vanity lighting system in accordance with this invention. It is envisioned that those skilled in the art can and will design alternative embodiments of this invention that infringe on this invention as set forth in claims below either literally or through the Doctrine of Equivalents.

What is claimed is:

1. A lighting system comprising:

a first elongated segment including a front face, a rear face opposite the front face, a first side wall, a second side wall opposite the first side wall, a first end face, a second end face opposite the first end face, at least one lamp socket disposed on the front face, at least one mounting device affixed to the rear face to connect the rear face side to a surface, and a female electrical connector disposed on the second side wall proximate to the second end face and electrically coupled to the at least one lamp socket;

a second elongated segment including a front face, a rear face opposite the front face, a first side wall, a second side wall opposite the first side wall, a first end face, a second end face opposite the first end face, at least one lamp socket disposed on the front face, at least one mounting device affixed to the rear face to connect the rear face side to a surface, a male electrical connector disposed on the first end face and configured to mate with the female electrical connector of the first elongated segment, and a female male electrical connector disposed on the second end face;

a third elongated segment including a front face, a rear face opposite the front face, a first side wall, a second side wall opposite the first side wall, a first end face, a second end face opposite the first end face, at least one lamp socket disposed on the front face, at least one mounting device affixed to the rear face to connect the rear face side to a surface, and a male electrical connector disposed on the first side wall proximate to the first end face and configured to mate with the female electrical connector of the second elongated segment, the male electrical connector electrically coupled to the at least one lamp socket and;

a power cord mounted to the first end face of the first elongated segment and electrically coupled to the at least one lamp socket of the first elongated segment.

2. The lighting device of claim 1 wherein the first, second, and third segments each include a plurality of lamp sockets.

3. The lighting device of claim 1 wherein the at least one mounting device of the first, second, and third segments comprises a suction cup.

4. The lighting device of claim 2 further including a tab extending outward from a perimeter of the suction cup to facilitate removal.

5. The lighting device of claim 1 wherein the first, second, and third segments each include a plurality of mounting devices.

6. The lighting device of claim 5 wherein the plurality of mounting devices of the first, second, and third segments each comprise spaced apart suction cups.

7. The lighting device of claim 6 further including a tab extending outward from a perimeter of each suction cup to facilitate removal.

8. The lighting device of claim 1 wherein at least one of the male electrical connectors on the first, second, and third segments is swivel mounted.

9. The lighting device of claim 1 wherein at least one of the female electrical connectors on the first, second, and third segments is swivel mounted.

10. The lighting device of claim 1 wherein the first, second, and third segments further include internal supports.

* * * * *